US007775491B1

(12) United States Patent
Samu

(10) Patent No.: US 7,775,491 B1
(45) Date of Patent: Aug. 17, 2010

(54) GUITAR HANGER

(76) Inventor: Christopher A. Samu, 1185 Solano Ave., #115, Albany, CA (US) 94706

( * ) Notice: Subject to any disclaimer, the term of this patent is extended or adjusted under 35 U.S.C. 154(b) by 0 days.

(21) Appl. No.: 12/413,973

(22) Filed: Mar. 30, 2009

(51) Int. Cl.
*A47B 96/06* (2006.01)
*A47G 29/00* (2006.01)

(52) U.S. Cl. ..... 248/215; 248/304; 248/339; 248/340; 84/327

(58) Field of Classification Search ..... 248/215, 248/225.21, 222.52, 225.11, 306, 305, 303, 248/339, 340; 84/327
See application file for complete search history.

(56) References Cited

U.S. PATENT DOCUMENTS 1,389,218 A * 8/1921 Primeau ..... 211/104
1,480,829 A * 1/1924 Moran ..... 211/32
2,091,008 A * 8/1937 McKinstry ..... 303/40
D308,782 S * 6/1990 Getsi ..... D6/567
4,991,809 A * 2/1991 Harkey ..... 248/229.12
5,372,346 A * 12/1994 Upchurch et al. ..... 248/304
2007/0039446 A1* 2/2007 Samu ..... 84/327
2009/0212499 A1* 8/2009 Scarborough ..... 273/295
2009/0213598 A1* 8/2009 Terry ..... 362/419
2009/0242499 A1* 10/2009 Rosselli ..... 211/85.6

* cited by examiner

*Primary Examiner*—Amy J Sterling
(74) *Attorney, Agent, or Firm*—Bay Area Technology Law Group PC

(57) ABSTRACT

A guitar hanger for hanging a guitar having a neck and head on a closet rod. The hanger includes a first member in the form of a shaft having a proximal end and a distal end, the proximal end configured into a first hook sized to receive the closet rod and a distal end configured on a second hook for engaging a second member. The second member is in the form of U-shaped yoke section sized to receive a guitar neck between legs of the U-shaped yoke section but not a guitar head. The second member also includes a transitional section having a body and a keyed slot configured within the body sized and shaped such that the keyed slot will removably receive the second hook in a first orientation and will secure the transitional section to the second hook in a second orientation such that the second member is removable from the first member only in the first orientation.

10 Claims, 2 Drawing Sheets

GUITAR HANGER

TECHNICAL FIELD

The present invention is directed to a simple yet effective device for storing and hanging a musical instrument such as a guitar. The invention is elegant in its simplicity and function, essentially allowing an individual to store a guitar as easily as they hang up a shirt, and in a location safer and more appropriate than many traditional storage devices

BACKGROUND OF THE INVENTION

Guitar storage has been somewhat of a challenge to musicians over the years. Professional musicians often times own more than one guitar and, in some cases, many guitars, both acoustic and electric and storing them has proven problematic.

Most guitars are kept in their own dedicated cases to both protect the guitar and to keep the instrument relatively dust and debris free. Although not an elegant solution, many musicians routinely prop their guitars up against furniture around the house, or place their guitars back in their cases and simply push the cases under a bed in order to hide them from view. Obviously, this is hardly a solution to a storage problem that musicians find ideal. Nevertheless, more acceptable alternatives have not been made commercially available.

In a review of the prior art, it is noted that U.S. Pat. No. 5,372,346 suggests hanging a guitar from a cushioned swivel hook which is in turn screwed or otherwise mounted on a vertical surface such as a wall. In doing so, not only is the guitar exposed to the exterior of the wall, but it is also exposed to dust and other fouling debris which generally accumulates on household furniture and appliances; a solution that is better suited to a recording studio, or on stage where the device can be attached to the side of a large speaker cabinet for easy access while performing Most musicians would find the swivel hook of the '346 patent a poor alternative to guitar case storage.

U.S. Pat. No. 5,911,396 discloses a closet guitar hangar structural frame device, which is rather complex in construction requiring upper and lower frame members which engage one another to provide a hangar which is adjustable. However, such a frame hangar device must be disassembled in order to enable it to engage and thus be supported by a suitable closet rod and, in operation, the frame members are capable of disengagement which could result in a catastrophic drop of the guitar to the floor below.

U.S. Pat. No. 7,464,910 teaches yet a further iteration of the guitar hanger in the form of a hook, a curved section extending down from the hook, a transition connecting the curve to a reverse curl, a horizontal section connected to the reversed curl and a V-member having first and second legs for engaging the headstock and neck of a guitar However, in that the V-member of the '910 patent is open ended at the top of the "V," it would be quite easy and in fact probable that a guitar would accidentally drop from the hanger assembly resulting in a catastrophic loss. Although such an arrangement is capable of storing the guitar in a closet beneath a closet rod, the potential damage which could be inflicted upon the guitar by using the '910 hanger would certainly outweigh the benefits of doing so It is thus an object of the present invention to provide a guitar hangar which not only performs well in supporting a guitar but is quite simple to manufacture and use, thus encouraging its use by instrument owners.

This and further objects will be more readily appreciated when considering the following disclosure and appended claims.

SUMMARY OF THE INVENTION

A guitar hanger for hanging a guitar having a neck and a head on a closet rod comprising a first member in the form of a shaft having a proximal end and a distal end, said proximal end comprising a first hook sized to receive said closet rod and said distal end comprising a second hook, a second member comprising a U-shaped yoke section sized to receive a guitar neck between legs of said U-shaped yoke section but not a guitar head, and a transitional section, said transitional section having a body and a keyed slot configured within said body sized and shaped such that said keyed slot will removably receive said second hook in a first orientation and will secure said transitional section to said second hook in a second orientation such that said second member is removable from said first member only in said first orientation.

DETAILED DESCRIPTION OF THE INVENTION

Figure 1:
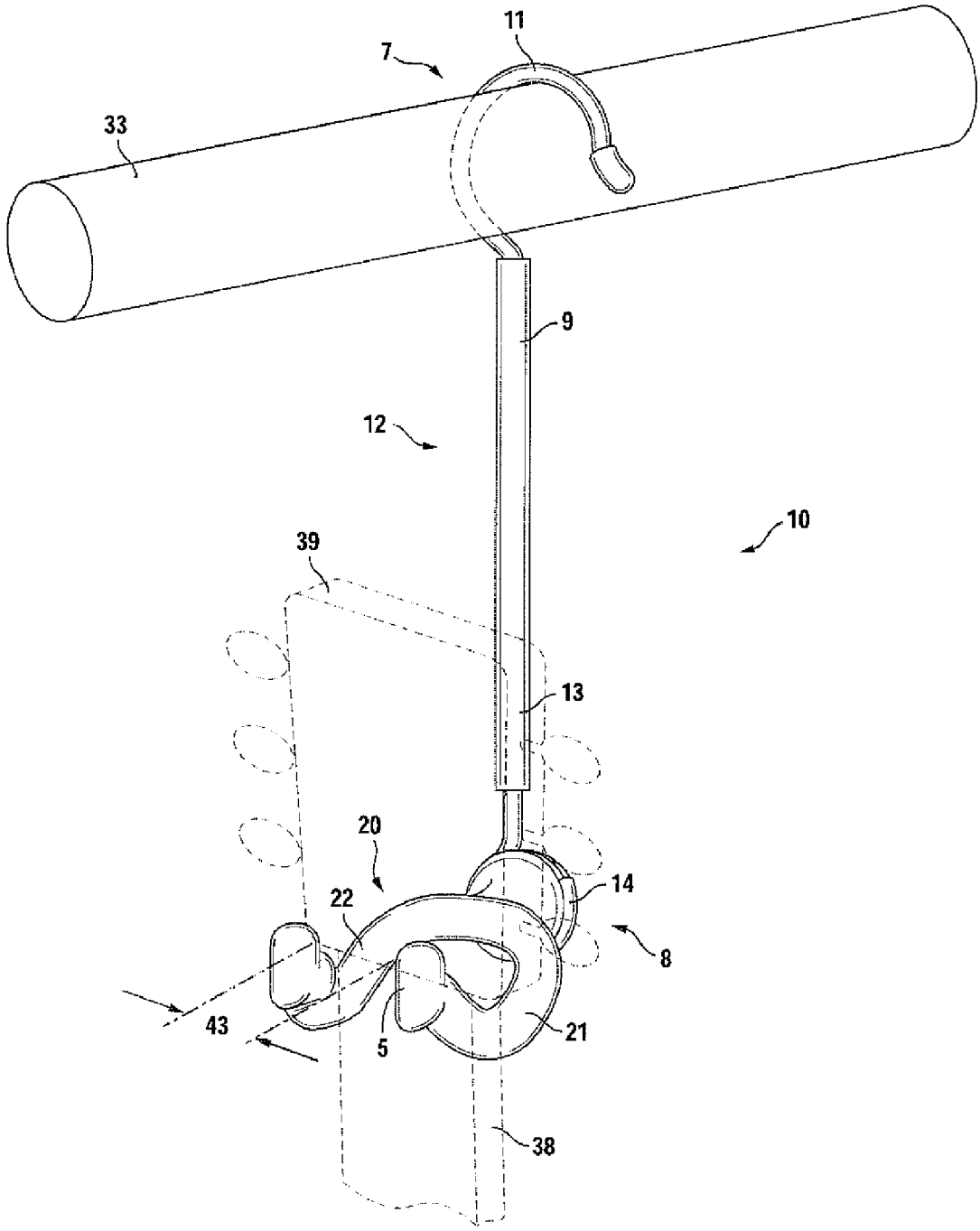
FIG. 1 is a perspective view of the guitar hanger of the present invention.
Figure 3:
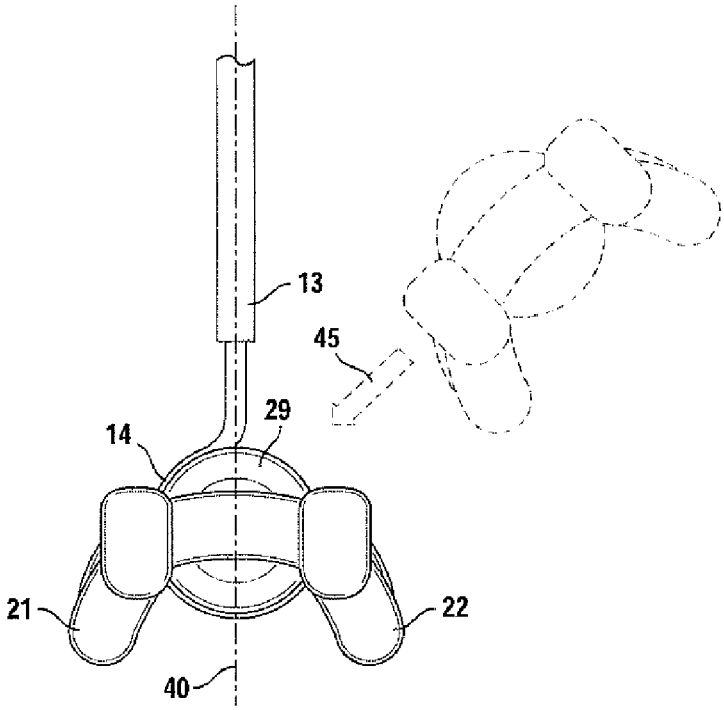
FIG. 3 is a front view of a portion of the present invention depicting how first and second members interact with one another to provide a releaseable yet secure attachment interface for securing a guitar in a hanging relationship as intended through the practice of the present invention.

The elegantly simple yet effective guitar hanging device of the present invention can perhaps best be appreciated by initially referencing FIGS. 1 and 3 This device comprises first member 12 in the form of linear rod 13 which may be partially encased in membrane 9 to enhance the aesthetic appeal of the present invention and to provide cushioning when desired.

The guitar hanger has proximal end 7 and distal end 8, the proximal end comprising first hook 11 sized to receive closet rod 33. Distal end 8 comprises second hook 14.

Figure 2A:
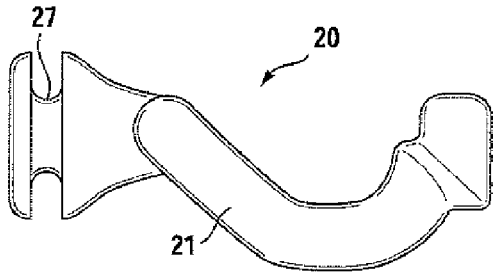
FIGS. 2A and 2B are side and top views, respectively, of what is referred to as the second member of the present hanger depicting the detail thereof.
Figure 2B:
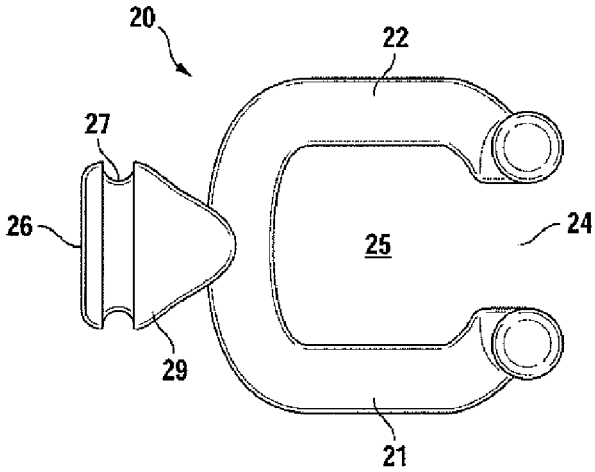

Second member 20 comprises a U-shaped yoke section best seen in reference to FIGS. 2A and 2B This U-shaped yoke section is sized to receive guitar neck 38 between legs 21 and 22 but not guitar head 39. Thus, when a guitar is placed within the U-shaped yoke section between legs 21 and 22, the latter extends horizontally from linear rod 13 and perpendicular to longitudinal axis 40. In doing so, a traditional guitar will be firmly secured therein.

As a preferred embodiment, legs 21 and 22 are characterized as having upturned ends 5 for engaging head 39 and to substantially prevent the guitar from inadvertently disengaging from the hanger. As a further preferred embodiment, when legs 21 and 22 of the U-shaped yoke section are provided with converging ends such that they are spaced only a distance 43 from one another, a channel 24 is created narrower than area 25 so that neck 38 is capable of passing between the converging ends only in a first orientation and not in a second orientation. In other words, the guitar would be introduced to the U-shaped yoke member in a first orientation and then turned 90 degrees once within area 25 to secure the guitar thereto. One wishing to remove the guitar from the present hanger, would turn the neck 90 degrees and slide it from the U-shaped yoke member between upturned ends 5 to clear spacing 43.

As noted, the present invention includes removable second member 20 best visualized in reference to FIGS. 2A and 2B Supporting the U-shaped yoke section described above is transitional section 26 having body portion 29 and keyed slot 27 configured within body portion 29 and having a unique geometry for synergistically engaging second hook 14 of second distal end 8. In comparing FIGS. 2A and 2B, it is noted that keyed slot 27 is not uniformly circular but instead is shaped such that it will removably receive second hook 14 in a first orientation shown in phantom in FIG. 3 and will secure transitional section 26 to second hook 14 when rotated to a second orientation again depicted in FIGS. 1 and 3. Because removable second member 20 is freely rotatable within second hook 14, guitars having asymmetric head stocks can be accommodated, thus allowing them to hang vertically from closet rod 33.

In summary, the present invention is directed to guitar hanger 10 for hanging a guitar having a neck 38 and head 39 on closet rod 33 comprising first member 12 ideally in the form of shaft 13 having proximal end 7 and distal end 8, the proximal end terminating in first hook 11 for receiving closet rod 33 and distal end 8 terminating in second hook 14. Second member 20 comprises a U-shaped yoke section sized to receive guitar neck 38 between legs 21 and 22 but not guitar head 39. Linear shaft 13 is characterized as having longitudinal axis 40 extending vertically from closet rod 33 when the present device is in use. Keyed slot 27 will removably receive second hook 14 when legs 21 and 22 of the U-shaped yoke section align diagonally with respect to one another from longitudinal axis 40 thus enabling second member 20 to rotatably engage second hook 14. Once second hook 14 is engaged by key slot 27 in the orientation shown in phantom in FIG. 3, second member 20 will secure to second hook 14 when legs 21 and 22 align horizontally with respect to one another and perpendicularly to longitudinal axis 40.

It should further be quite apparent in viewing the appended figures and description recited above, that second member 20 can engage second hook 14 from either side of the hook, that is, from the left or right side of the hook as desired by a user. The elegance and simplicity of the present invention should also be quite apparent from this description noting that the present two piece structure is inexpensive to fabricate and yet provides a selectively removable and yet locking relationship between the parts to prevent even the possibility of a catastrophic loss of a guitar through its disengagement from the hanger device of the present invention

What is claimed is:

1. A guitar hanger for hanging a guitar having a neck and a head on a closet rod comprising a first member in the form of a shaft having a proximal end and a distal end, said proximal end comprising a first hook sized to receive said closet rod and said distal end comprising a second hook, a second member comprising a U-shaped yoke section sized to receive a guitar neck between legs of said U-shaped yoke section, but not a guitar head and a transitional section, said transitional section having a body and a keyed slot configured within said body sized and shaped such that said keyed slot will removably receive said second hook in a first orientation and will secure said transitional section to said second hook in a second orientation such that said second member is removable from said first member only in said first orientation.

2. The guitar hanger of claim 1 wherein said second member is releasable from said distal end only when said legs of said U-shaped yoke member are diagonally oriented with respect to one another.

3. The guitar hanger of claim 1 wherein said second member is lockably secured to said distal end when said legs of said U-shaped yoke member horizontally aligned with respect to one another.

4. The guitar hanger of claim 1 wherein said legs of said U-shaped yoke section are characterized as having upturned ends for engaging said head and to substantially prevent said guitar from inadvertently disengaging from said hanger.

5. The guitar hanger of claim 1 wherein said legs of said U-shaped yoke section are characterized as having converging ends spaced apart from one another such that said neck is capable of passing between said converging ends in a first orientation but not in a second orientation.

6. A guitar hanger for hanging a guitar having a neck and head vertically below a closet rod, said guitar hanger comprising a first member in the form of a substantially linear shaft having a longitudinally axis extending vertically from said closet rod when in use and having a proximal end and a distal end, said proximal end comprising a first hook sized to receive said closet rod and said distal end comprising a second hook, a second member comprising a U-shaped yoke section sized to receive a guitar neck between legs of said U-shaped yoke section, but not a guitar head and a transitional section, said transitional section having a body and a keyed slot configured within said body sized and shaped such that said keyed slot will secure said transitional section to said second hook when said legs of said U-shaped yoke section extend horizontally with respect to one another from said longitudinal axis.

7. The guitar hanger of claim 6 wherein said second member is removable from said second hook only when said legs of said U-shaped yoke section are rotated as to not extend horizontally with respect to one another.

8. The guitar hanger of claim 7 wherein said second member is removable from said second hook when said legs of said U-shaped yoke section extend diagonally with respect to one another from said longitudinal axis.

9. The guitar hanger of claim 1 wherein said second member is rotatable within said second hook.

10. The guitar hanger of claim 9 wherein guitars having asymmetric head stocks are caused to hang vertically from said closet rod when supported by said second member.

* * * * *